US008529144B2

(12) United States Patent
Vanheuverzwijn

(10) Patent No.: US 8,529,144 B2
(45) Date of Patent: Sep. 10, 2013

(54) INTEGRATED BIDIRECTIONAL URGE UNIT FOR CONTINUOUS FEED PRINTERS

(75) Inventor: Etienne Vanheuverzwijn, Wezembeek Oppem (BE)

(73) Assignee: Xerox Corporation, Norwalk, CT (US)

( * ) Notice: Subject to any disclaimer, the term of this patent is extended or adjusted under 35 U.S.C. 154(b) by 347 days.

(21) Appl. No.: 12/904,607

(22) Filed: Oct. 14, 2010

(65) Prior Publication Data

US 2012/0093559 A1 Apr. 19, 2012

(51) Int. Cl.
*B41J 15/00* (2006.01)

(52) U.S. Cl.
USPC ..... 400/619; 399/407; 399/384; 242/615.12

(58) Field of Classification Search
USPC ..... 400/619; 399/384, 388, 397, 407; 242/615.12; 226/92
See application file for complete search history.

(56) References Cited

U.S. PATENT DOCUMENTS

| | | | | |
|---|---|---|---|---|
| 6,450,711 | B1 | 9/2002 | Conrow | |
| 6,666,399 | B2 * | 12/2003 | Perdu | 242/615.12 |
| 6,786,149 | B1 | 9/2004 | Lomoine et al. | |
| 2007/0041049 | A1 | 2/2007 | Kojima et al. | |
| 2007/0081064 | A1 | 4/2007 | Spencer et al. | |

* cited by examiner

*Primary Examiner* — Matthew G Marini
(74) *Attorney, Agent, or Firm* — Ronald E. Prass, Jr.; Prass LLP

(57) ABSTRACT

According to aspects of the embodiments, there is provided an apparatus and method to provide a modification of the paper path in an image forming system including a plurality of printing modules, and having a simplex mode that an image is formed on a front surface of a continuous medium, and a duplex mode that an image is also formed on a rear surface of a continuous medium, the image forming system further comprises a bidirectional urge unit added in the middle of the paper path tunnel. Placement of a bidirectional urge unit allows the continuous medium to be transported in two directions.

17 Claims, 5 Drawing Sheets

INTEGRATED BIDIRECTIONAL URGE UNIT FOR CONTINUOUS FEED PRINTERS

BACKGROUND

The present disclosure relates to a continuous feed printing system that integrates one or more printing modules, and more particularly, to an urge unit in a paper path tunnel of the printing system.

In a typical continuous feed (CF) printing systems are supplied by extended lengths of sheet media, which are commonly provided in bulk roll form. Such lengths of sheet media are sometimes referred to as webs, continuous media and the like. One benefit of utilizing such a printing system is that the frequent resupplying of pre-cut sheets of media is avoided. Thus, such continuous feed printing systems, once setup for production, can sustain operation for long periods of time, which can help to increase productivity and reduce production costs.

There are occasions, however, that a document may call for one or more pages that are printed on sheet media having different properties and/or characteristics than that of the continuous length of sheet media being supplied to the printing system. For example, such pages may call for sheet media of a different size, a different type or material than that of the length of sheet media being supplied to the printing system, or different content such as text, graphics, color and the like. Unfortunately, the efficiencies and cost savings that might otherwise be associated with the production of such a document on a continuous feed printing system are often significantly reduced due to the call for sheets of media having these different properties and/or characteristics.

In such cases, these additional pages of the document may be produced on a different printing system or, in some cases, at a different time on the same printing system. In Duplex Continuous Feed (CF) environment, the paper is transported from the upstream printer to the downstream one via a turn bar paper path system using urge units. These urge units are designed to transport the paper in one direction and are independent from the paper path. Additionally, the urging units are located in the paper path external to the printers and transport paper from a simplex printer to a duplex printer. When the paper has to be transported in both directions two urge units must be used. The use of external urge units has been known to increase Paper skewing and the use of two urging units increases the cost of the CF printer system.

For the reasons stated above, and for other reasons stated below which will become apparent to those skilled in the art upon reading and understanding of the present specification there is need in the art for print media transportation to be handled in both directions with a single urge unit.

SUMMARY

According to aspects of the embodiments, there is provided an apparatus and method to provide a modification of the paper path in an image forming system including a plurality of printing modules, and having a simplex mode that an image is formed on a front surface of a continuous medium, and a duplex mode that an image is also formed on a rear surface of a continuous medium, the image forming system further comprises a bidirectional urge unit added in the middle of the paper path tunnel. Placement of a bidirectional urge unit allows the continuous medium to be transported in two directions.

DETAILED DESCRIPTION

Figure 1:
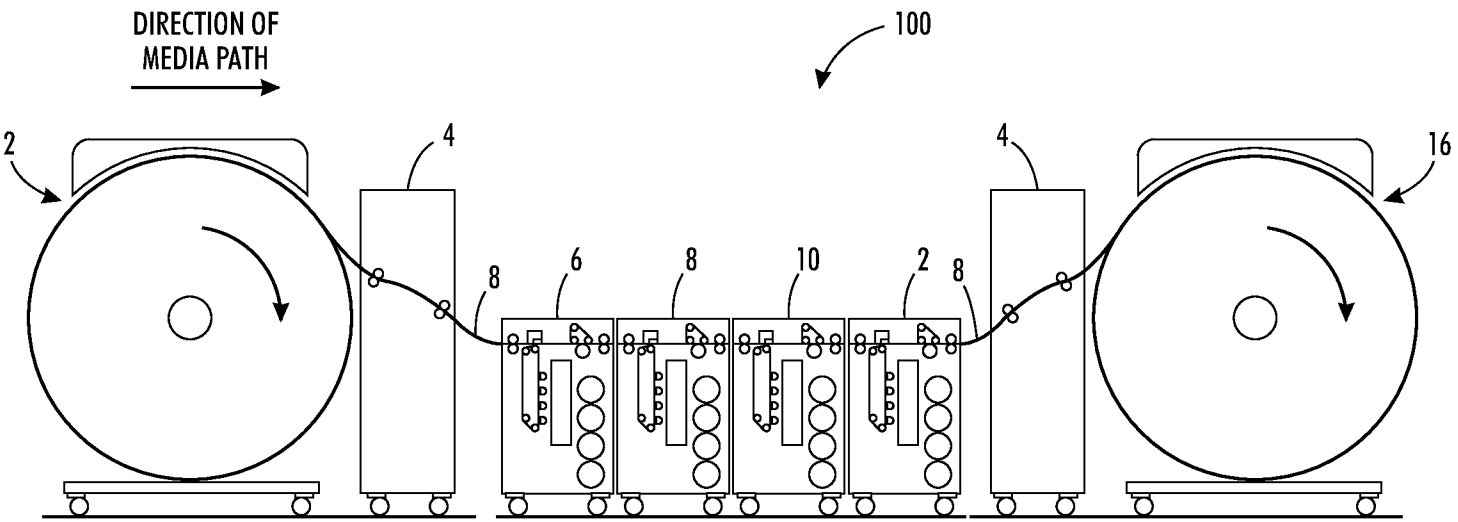
FIG. 1 illustrates a modular continuous feed printing system with a bidirectional guide in accordance to an embodiment.

In accordance with various aspects described herein, systems and methods are described that relate to a media urge unit for a printing system, to a printing system which incorporates the urge unit, and to a method of printing. The urge unit includes first and second pathways which intersect at a bidirectional guide. The first pathway includes an input path which carries sheets of print media to a second print module and an output path which carries the print media sheets from the second print module to a second processing device. Similarly, the second pathway includes an input path which carries print media sheets to the bidirectional guide and an output path which carries print media sheets from the guide to a first processing device, the output path receiving print media sheets from the input path. The guide serves as a portion of both pathways. Sheets traveling on the first and second pathways can both pass through the guide. However, a sheet cannot traverse the junction from one of the pathways while a sheet in the other pathway is simultaneously in the junction as this would result in a collision. Accordingly, the entry of sheets to the crossover junction is staggered.

In yet another aspect, the disclosed embodiment relate to a printing system comprising a plurality of print modules operating at simplex mode where an image is formed on a front surface of a continuous medium and a duplex mode where an image is also formed on a rear surface of a continuous medium; a first feed device that feeds a continuous medium; a first print module that forms an image on the continuous medium fed from the first feeding device; a bidirectional guide comprising a first transport path that the continuous medium is transported in from the first print module device, and a second transport path that the continuous medium is transported out in a direction that is substantially the same as the transporting in direction of the first transport path; a first post-processing device that post-processes the continuous medium transported out by the second transport path of the bidirectional guide; a second print module that forms an image on the continuous medium transported out by the first transport path of the bidirectional guide; and a second post-processing device that is provided on a downstream side of the second print module and post-processes the continuous medium.

Still further aspect, the disclosed printing system wherein in the simplex mode, the continuous medium fed from the first feeding device being transported to the first post-processing device via the first print module and second transport path, and in the duplex mode, the continuous medium being transported to the second post-processing device via the first print module, first transport path, and second print module.

Still further aspect, the disclosed printing system wherein at least one of the first and second print media processing units comprises a marking engine.

Further aspect, the disclosed printing system wherein the bidirectional guide comprises a pair of support rollers disposed adjacent to each other allowing the continuous medium to be threaded and fed in the direction of the first transport path or the second transport path.

Still further aspect, the disclosed printing system wherein the second printing module is a monochrome printing module and the first printing module is a color printing module.

In yet another aspect, the disclosed printing system wherein the front surface and the rear surface of the continuous medium are reversed by a turn bar disposed between the first and second print modules.

Still further aspect, the disclosed printing system wherein the bidirectional guide is disposed after the turn bar and after the first print module.

In yet another aspect, the disclosed embodiments pertain to a media web printing method comprising feeding from a first feed device a continuous medium through a first print module to form an image on the continuous medium fed from the first feeding device; guiding through a bidirectional guide that comprises a first transport path that the continuous medium is transported in from the first print module device, and a second transport path that the continuous medium is transported out in a direction that is substantially the same as the transporting in direction of the first transport path; when the continuous medium transported out by the second transport path of the bidirectional guide processing the continuous medium in a first post-processing device; when the continuous medium transported out by the first transport path of the bidirectional guide feeding the continuous medium through a second print module to form an image on the continuous medium; and post-processing the continuous medium at a second post-processing device that is provided on a downstream side of the second print module; wherein the first and second print modules operate at a simplex mode where an image is formed on a front surface of the continuous medium and a duplex mode where an image is also formed on a rear surface on the continuous medium.

In further aspects, the disclosed embodiments pertain to a xerographic printing system comprising a first marking engine, a second marking engine; a source of print media; an output destination; a bidirectional guide comprising a first transport path that the print media is transported in from the first marking engine, and a second transport path that the print media is transported out in a direction that is substantially the same as the transporting in direction of the first transport path; and a print media conveyor system which conveys sheets of print media between the source of print media and the first and second marking engines, and between the first and second marking engines and the output destination, the conveyor system comprising the media bidirectional guide; wherein the first and second marking engines operate at a simplex mode where an image is formed on a front surface of the print media and a duplex mode where an image is also formed on a rear surface on the print media.

The term "print media" generally refers to a usually flexible, sometimes curled, physical sheet of paper, plastic, or other suitable physical print media substrate for images, whether precut or web fed such as a continuous medium. A "simplex" document or copy sheet is processed only on one side or face of the sheet, whereas a "duplex" document or copy sheet is processed on both sides.

The term "image forming machine " or "printing system" as used herein refers to a digital copier or printer, electrographic printer, xerographic printing system, continuous feed printer, continuous feed inkjet printer, bookmaking machine, facsimile machine, multi-function machine, or the like and can include several marking engines, as well as other print media processing units, such as paper feeders, finishers, and the like. The term "electrophotographic printing machine," is intended to encompass image reproduction machines, continuous feed printer, continuous feed inkjet printer, electrophotographic printers and copiers that employ dry toner developed on an electrophotographic receiver element.

FIG. 1 illustrates a continuous feed printing system 100 that incorporates a media roll input 2, media roll input adapter 4, multiple printing modules 6, 8, 10, and 2, a media roll output adapter 4 and a media roll output 6. A continuous feed (CF) printing system prints on a band or roll of paper as compared to a sheet printing system which prints on discrete sheets of media. The media roll input 2 unwinds in a clockwise direction as the web of paper 8 is fed by the input adapter 4 to a first printing module 6. The paper web 8 continues to proceed through the second print module 8, third print module 10 and fourth print module 2. The web 8 continues to be processed through the output adapter 4 which feeds the paper web onto a media roll output 6. Any post processing, such as paper cutting, required is performed external to the CF printing system illustrated in FIG. 1. Other variations of a CF printing system are available, such as the printing system disclosed in U.S. Pat. No. 7,451,697, issued to Moore, which is incorporated by reference herein. For duplex operation, the sheet is reversed in position by an inverter (not shown) and transported to receive an image on the reverse side by the same print module or at a different print module and in the same manner as the image was deposited on the first side of the sheet.

Figure 2:
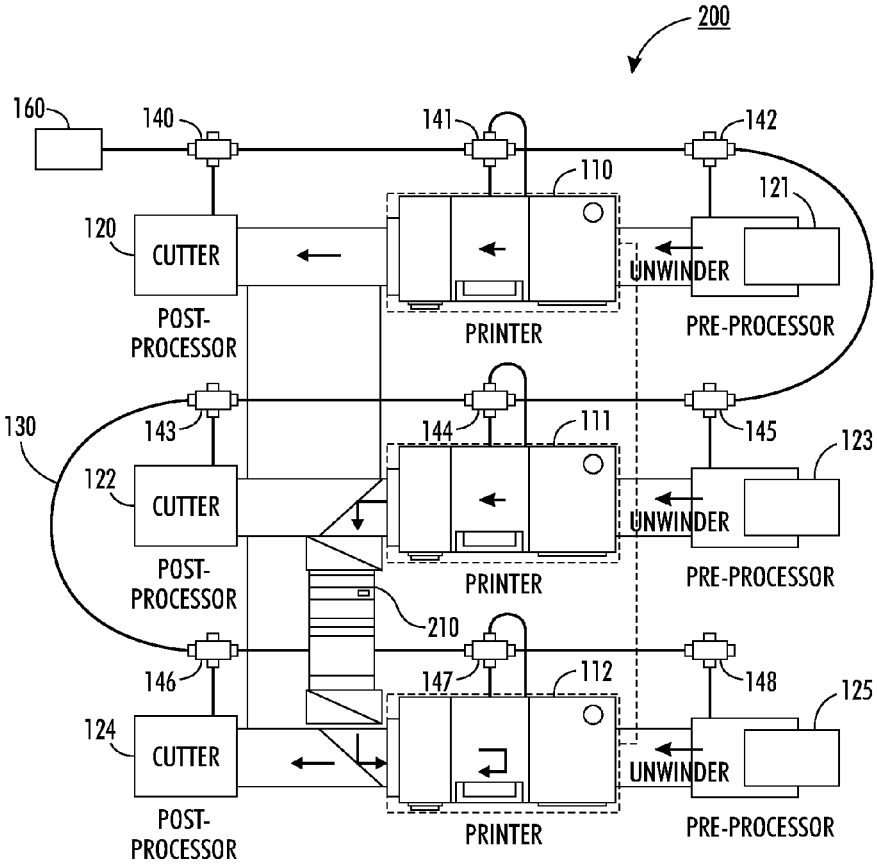
FIG. 2 illustrates a bidirectional guide in a continuous feed printing system in which three printers have been connected as one duplex line and one simplex line in accordance to an embodiment.

FIG. 2 illustrates a bidirectional guide in a continuous feed printing system arrangement 200 in which three printers have been connected as one duplex line and one simplex line in accordance to an embodiment.

The arrangement 200 illustrates a continuous feed printing system in which three printers have been connected as one duplex line and one simplex line. System 100 according to the present invention, includes at least three printers 110, 111 and 112 and print-related devices 120-125, which are connected to a common print line bus 130 by means of associated print line bus adapters 140-148. The print line bus adapters 140-148 are powered via the print line bus 130 by a power supply (not shown). At least one of the printing modules or printing devices 110, 111, 112 provides for a graphical user interface that implements a print line management layer. It should be noted that the printing modules can be monochrome printing modules, color printing modules, or a combination thereof. A corresponding print line management unit 160 may be connected, for example, via a RS232 cable or network data line to any one of the print line bus adapters 140-148. Communication between the print line management unit 160 and the corresponding print line bus adapter 140-148 may be performed, for example, via a type-2 protocol. In this embodiment, the print line management unit 160 is separate from the other devices. In another embodiment (described below), print line management may be provided using a software layer running in one or more of the printers.

In the following description, the terms "printing module", "printing device" and "paper master" are synonymously used to designate the devices 110, 111 and 112. The terms "print line bus adapter" and "adapter" are synonymously used to designate the devices 140-148. The terms "pre-processor"

and "pre-processor paper slave" are synonymously used to designate the devices 121, 123 and 125. The terms "post-processor" and "post-processor paper slave" are synonymously used to designate the devices 120, 122 and 124. The term "paper slave" is further used to designate any of the devices 120-125.

Each printing device 110, 111, 112 preferably represents a paper master, a device that has the capability to direct the paper movement. Usually it also has the capability to actually drive the paper. Typically, printers are paper masters. When there are several paper masters in a single paper path, they need to be synchronized (as is the case in a duplex line). Paper masters are continuous feed (CF) printers. A CF printer, as opposed to cut sheet printer, prints on a band/roll of paper, not on separated sheets. Typically, it will drive the paper using sprocket holes on the sides, but "pinless" friction drive or any other technology is possible.

Each print-related device 120-125 preferably represents a paper slave, i.e., a device that does not have the capability to decide by itself to pull/move the paper. It may be able to actually drive the paper but it requires an external request to do so. It may also request the paper movement, but will wait for a paper master of the segment to actually move paper. Typically, paper slaves will regulate their speed on the pace set by (one of) the paper masters by regulating/synching on a paper loop or by receiving a paper advance clock signal and following it. Typically, pre/post-processors are paper slaves.

Pre-/post-processors are devices that feed paper into (PRE) and accept printed output from (POST) a printer. Pre- and post-processors are preferably adapted to the printing requirements. For example in a continuous feed printing environment a typical high-speed paper path is achieved using a roll unwinder as pre-processor and a re-winder, burster/trimmer/stacker (BTS), a cutter, an inserter (in envelopes), post-printers, labels stickers and so on as post-processors. The first post processing device is closest to the first printer, the second post processing device is closest to the second printer, and the Nth processing device is closest to the Nth printer.

The print line bus 130 is used to interface different paper masters and paper slaves in the print system 100 according to a defined print line segment. Each paper master 110, 111, 112 and each paper slave 120-125 is associated with a microprocessor controlled print line bus adapter 140-148 used to connect the corresponding paper master or slave to the print line bus 130. Each print line bus adapter 140-148 interfaces to its associated device using the device's own/native signals. The adapters 140-148 are connected to the print line bus 130 for power and communication, whereby the communication may be based on an automotive serial protocol such as a controlled area network (CAN) known for its real-time and intrinsic security features.

The print line bus adapters 140-148 are used to interface the associated paper masters and slaves to the print line bus 130 and may be used to serve to establish a segmentation of the print system 100. The print line bus adapters 140-148 serve for managing established print line segments by filtering data traffic transmitted over the print line bus 130 such, that associated devices only receive messages sent thereto.

The paper masters 110, 111, 112 comprised in the print line 100 according to FIG. 1 may be electrophotographic printing devices or any other suitable printing or document reproduction devices such as ink-jet printers or the like. The paper masters each include a document output region or assembly which outputs original printed documents or reproduction of printed documents, which are printed on a band/roll of paper in the case that the paper master 110, 111, 112 represents a CF printer.

Any pre-processor paper slave 121, 123, 125 in the print system 100 comprises at least an output region for feeding paper into a subsequent paper master. Each post-processor paper slave 120, 122, 124 includes an input interface which receives paper from the output region of the preceding paper master 110, 111, 112 or the preceding post-processor paper slave (not shown) and further includes a paper output region for outputting processed paper. A combination of turn bars (not shown) and bidirectional guides 210 are used to facilitate the feeding of the continuous media so as to prevent skewing and to enhance the quality of the print job. The processed paper may represent finished or partially finished documents provided to an end-user or, in the case that the post-processor paper slave interfaces with another post-processor paper slave or any other paper master, serves to forward the paper to said further post-processor paper slave. The input interface of any paper master or slave may include a mechanical interface such as a vacuum sheet transport surface, bidirectional guide 210, roller transport assembly, or the like for paper transport in a predetermined print line direction. The print line bus 130 serves for the transmission of control signals between the paper masters and slaves.

A system for continuous feed printing includes at least three printers, which can be organized as: two printers configured in a duplex line and one printer configured in a simplex line or as a backup for the duplex line. The system also includes paper path equipment for providing a path between the devices (Printers and Pre/Post Processing Equipments) to allow flexible implementation of every desired configuration. A low-level hardware interconnection, which may be implemented through a print line bus (PLB) or other available technology, to provide a paper motion synchronization and status reporting mechanism within a selected print line segment. The system also employs print line segmentation, which allows the definition of a logical line within a physical line configuration, called a print line segment. A local network interconnects the printers and guarantee each printer receives its own print data for performing the desired print job. An automatic, multiple/distributed database synchronization may be used to allow each printer to have its own database that stores all the printer/line parameters.

The system for high speed continuous feed printing can be pre-configured so that a user can select from one of several configurations or print line segments based on the user's job requirements. For example, in a system with three printers and associated pre-processors and post-processors, an operator can define a print line segment for each of all the logical combinations of duplex print lines with backup printer. For example, referring to FIG. 2, printers 111 and 112 are configured for duplex operation with printer 110 configured for simplex operation and available for backup. Other combinations include: printers 110 and 111 forming a duplex line with printer 112 configured for backup. Each desired configuration is defined and saved in the system's database as a print line segment. The system database may be stored on one of the printers or on a server on a local area network, which provides the data for the print jobs to the printers. Each printer has a memory for storing the configuration information. The definition activity normally takes place during the system installation and may be performed by a key account operator or an installation specialist. Alternatively, the definition information can be redefined in the field to accommodate a user's job requirements.

When a change of configuration is necessary (for any reason), a new print line segment is selected using the predefined print line segments stored in the database (or the operator can define a new print line segment and save it in the database, then select it). Each print line segment provides a particular configuration of the system. The operator only has to select the desired configuration through a scroll-down menu selection. The paper must then be threaded through the paper path according to the new configuration. No other modifications to hardware, software, electrical connections or physical configuration are required.

Configuration definitions may be made using print line segmentation. The print lines shown may be segmented. Segmentation allows for the definition of one or several independent paper paths using the devices 110, 111, 112 and 120-125 which form the print line in printing system 100 and continuous feed printing system arrangement 200. Segmentation allows logical groupings of physical devices such that an independent paper path exists. An independent paper path constitutes a segment of the print line and represents a finite and ordered set of print line devices that includes at least one paper master 110, 111, 112. Accordingly, there can be as many coexisting segments in one print line as there are paper masters within said print line. As a paper master representing a continuous feed printer can usually print from a box of paper to its internal stacker, a segment needs not to comprise a paper slave.

Segments currently in use are designated as operational segments. In order to avoid interference between such operational segments and segments that are defined but not currently in use, or unsegmented devices in the print line, which have not been allocated to any segment, the devices allocated to an operational segment must only receive messages directed to said devices. Furthermore, in order not to disturb the processing of an operational segment, a device allocated to a segment must be blocked from being allocated to another segment. Each paper master may be connected to a processing unit adapted for issuing print jobs representing data to be printed. If an operational segment comprises more than one paper master, the data to be printed may be issued from any of the paper masters.

The system for continuous feed printing offers the flexibility of using three printers in simplex mode (3 simplex) or 2 engines in duplex mode along with one engine used in simplex mode or used as a backup. The configuration selection is based on a logical reconfiguration of the line (printers+pre/post equipment).

Figure 3:
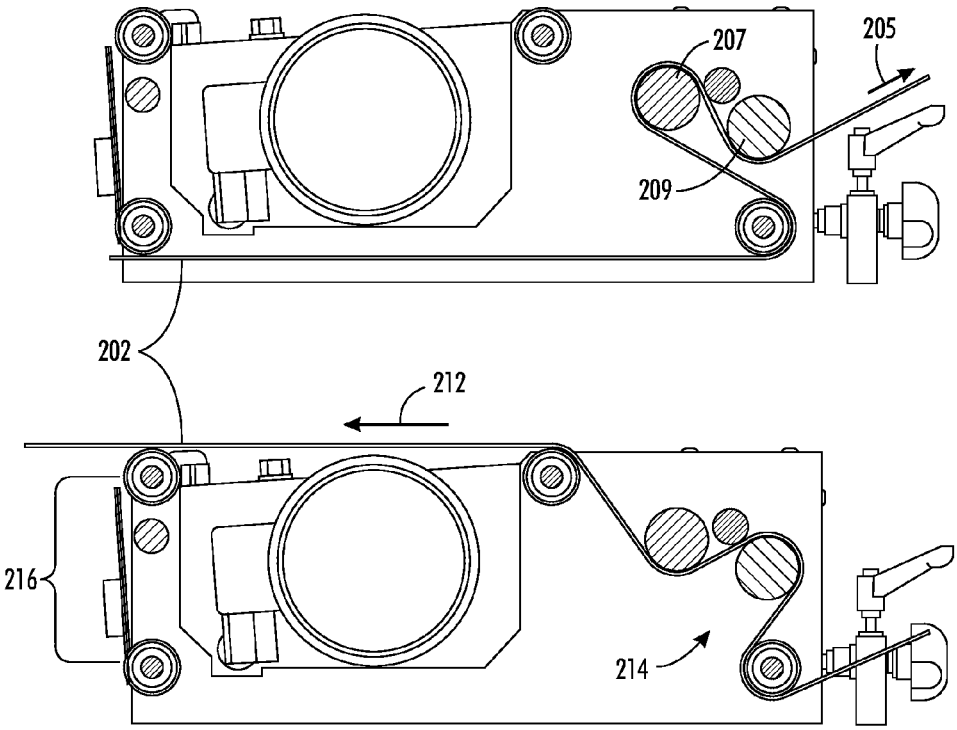
FIG. 3 illustrates a first and second transport path at the bidirectional guide in accordance to an embodiment.

FIG. 3 illustrates a first and second transport path at the bidirectional guide 210 in accordance to an embodiment. Bidirectional guide 210 comprising a first transport path 205 that the continuous medium 202 or web 8 is transported in from the first print module device, and a second transport path 212 that the continuous medium 202 is transported out in a direction that is substantially the same as the transporting in direction of the first transport path. The continuous medium 202 is threaded and fed 214 in the direction of the first transport path 205 or the second transport path 212 through a pair of support rollers 207 and 209 disposed adjacent to each other allowing the continuous medium to be routed in either direction. Roller mechanism 216 is adapted to receive a driving force from the continuous media 202 and to ease movement in a direction indicated by labels 205 and 212. A clamp mechanism 218 allows for the bidirectional guide 210 to be integrated and secured in the middle of the paper path tunnel of continuous feed printing system 200.

Figure 4:
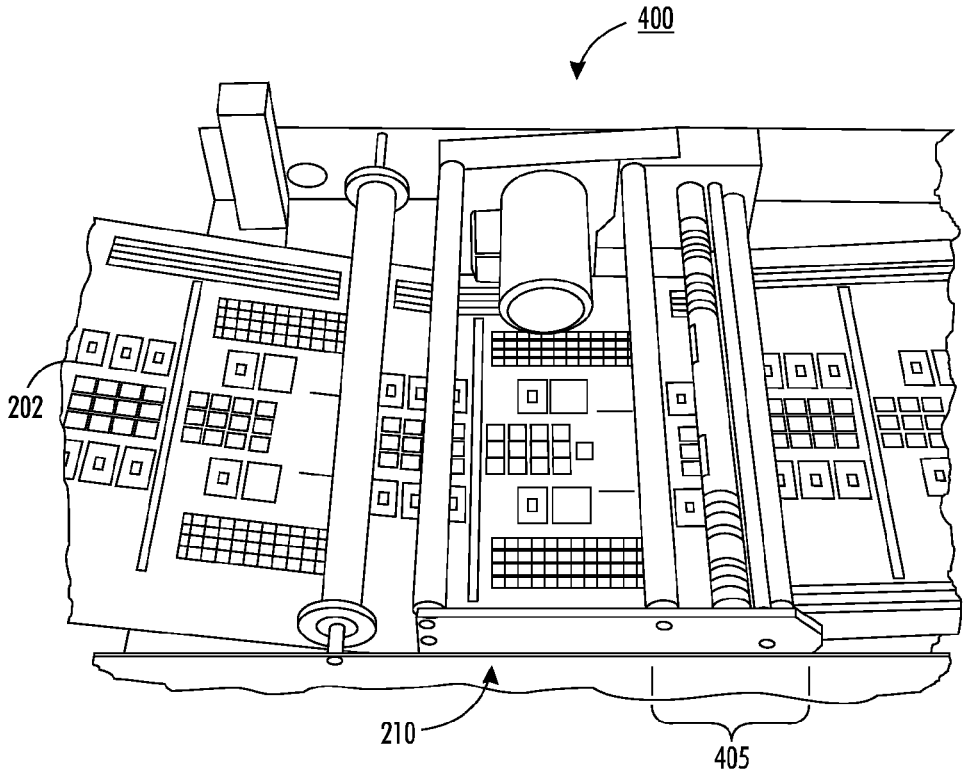
FIG. 4 is an illustration of the bidirectional guide in the path tunnel of a continuous feed printing system in accordance to an embodiment.

FIG. 4 is an illustration of the bidirectional guide in the path tunnel 400 of a continuous feed printing system in accordance to an embodiment. As shown the continuous media 202 is threaded 405 to support rollers in a desired direction.

Figure 5:
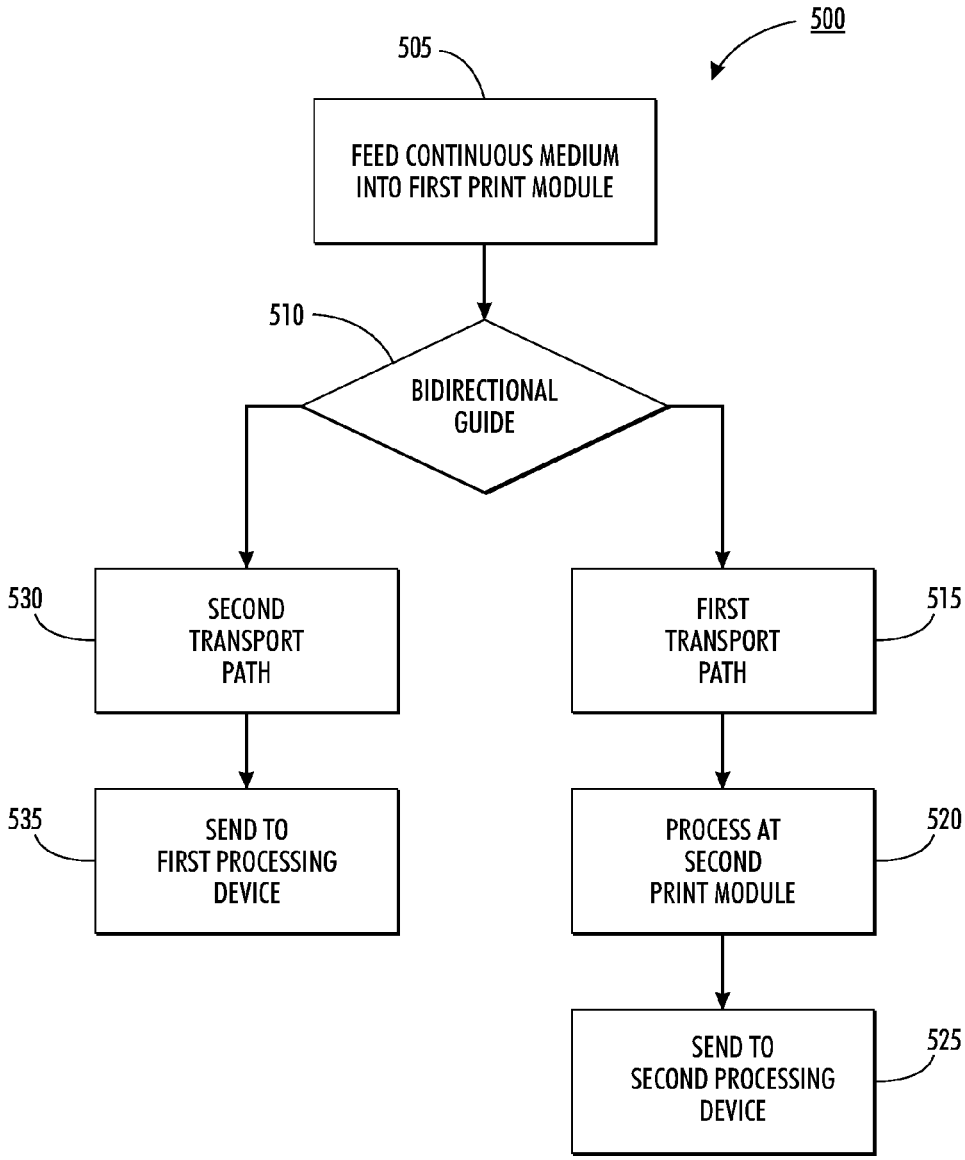
FIG. 5 is a flowchart of a method for using the bidirectional guide in a web printing system in accordance to an embodiment.

FIG. 5 is a flowchart of a method 500 for using the bidirectional guide in a web printing system in accordance to an embodiment. Method 500 begins with action 505 when the continuous media is fed into a print module like printer 110 by an unwinder such as unwinder 121 and 123 as shown in FIG. 2. The continuous media after is processed by the print media is fed and threaded through the bidirectional guide. In action 510, a decision is made as to the path for the continuous media. If a first path is selected as in action 515 the continuous media is processed as indicated by action 520. In action 520, the continuous media is processed the second print module. Control from action 520 is forwarded to action 525 where a second processing device is employed in accordance to the print job. The decision in action 510 could in the alternative have been the selection of a second path and control is passed to action 530. Inaction 530, the continuous media is threaded in accordance to the second transport path as outlined above with reference to FIG. 3. After action 630 control is then passed to action 535 where a first processing device is employed in accordance to the print job.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. A printing system comprising:

a plurality of print modules operating in a simplex mode in which an image is formed on a front surface of a continuous medium and in a duplex mode in which an image is also formed on a rear surface of the continuous medium;

a first feed device that feeds the continuous medium;

at least one of the plurality of print modules being a first print module that forms an image on the continuous medium fed from the first feeding device;

a bidirectional guide comprising a first transport path along which the continuous medium is transported in from the first print module, and a second transport path along which the continuous medium is transported out in a direction that is a reverse of, and substantially parallel to, a direction of the first transport path, the first transport path and the second transport path including at least one pair of support rollers disposed adjacent to each other allowing the continuous medium to be threaded therebetween and fed in the direction of the first transport path or the second transport path, the at least one pair of support rollers individually turning in a same direction whether transporting the continuous medium along the first transport path or the second transport path;

a first post-processing device that post-processes the continuous medium transported out by the second transport path of the bidirectional guide;

at least one of the plurality of print modules being a second print module that forms an image on the continuous medium transported out by the first transport path of the bidirectional guide; and a second post-processing device that is provided on a downstream side of the second print module and that post-processes the continuous medium.

2. The printing system according to claim 1, wherein:

in the simplex mode, the continuous medium is fed from the first feed device and is transported to the first post-processing device via the first print module and the second transport path, and in the duplex mode, the continuous medium is transported to the second post-processing device via the first print module, the first transport path, and the second print module.

3. The printing system according to claim 2, wherein at least one of the plurality of print modules comprises a marking engine.

4. The printing system according to claim 3, wherein the second print module is a monochrome printing module and the first print module is a color printing module.

5. The printing system according to claim 4, wherein the front surface and the rear surface of the continuous medium are reversed by passage of the continuous medium around a turn bar disposed between the first print module and the second print module.

6. The printing system according to claim 5, wherein the bidirectional guide is disposed downstream of the turn bar and the first print module in the direction of the first transport path.

7. A media web printing method comprising:

feeding from a first feed device a continuous medium through a first print module to form an image on the continuous medium fed from the first feed device;

guiding the continuous medium for transport through a bidirectional guide that comprises a first transport path for transporting the continuous medium in from the first print module, and a second transport path for transporting the continuous medium out in a direction that is a reverse of, and substantially parallel to, a direction of the first transport the first transport path and the second transport path including at least one pair of support rollers disposed adjacent to each other allowing the continuous medium to be threaded therebetween and fed in the direction of the first transport path or the second transport path, the at least one pair of support rollers individually turning in a same direction whether transporting the continuous medium along the first transport path or the second transport path;

when the continuous medium is transported out by the second transport path of the bidirectional guide, processing the continuous medium in a first post-processing device; and when the continuous medium is transported out by the first transport path of the bidirectional guide, feeding the continuous medium through a second print module to form an image on the continuous medium, and post-processing the continuous medium at a second post-processing device that is provided on a downstream side of the second print module;

wherein the first print module and the second print module operate in a simplex mode where an image is formed on a front surface of the continuous medium and a duplex mode where an image is also formed on a rear surface of the continuous medium.

8. The media web printing method according to claim 7, wherein:

in the simplex mode, the continuous medium is fed from the first feeding device and transported to the first post-processing device via the first print module and the second transport path, and in the duplex mode, the continuous medium is transported to the second post-processing device via the first print module, the first transport path, and the second print module.

9. The media web printing method according to claim 8, wherein at least one of the first print module and the second print module comprises a marking engine.

10. The media web printing method according to claim 9, wherein the second print module is a monochrome printing module and the first print module is a color printing module.

11. The media web printing method according to claim 10, wherein the front surface and the rear surface of the continuous medium are reversed by passage of the continuous medium around a turn bar disposed between the first print module and the second print module.

12. The media web printing method according to claim 11, wherein the bidirectional guide is disposed downstream of the turn bar and the first module in the direction of the first transport path.

13. A printing system comprising:

a first marking engine;

a second marking engine;

a source of a continuous print media;

an output destination;

a bidirectional guide comprising a first transport path along which the continuous print media is transported in from the first marking engine, and a second transport path along which the continuous print media is transported out in a direction that is a reverse of, and substantially parallel to a direction of the first transport path, the first transport path and the second transport path including at least one pair of support rollers disposed adjacent to each other allowing the continuous medium to be threaded therebetween and fed in the direction of the first transport path or the second transport path, the at least one pair of support rollers individually turning in a same direction whether transporting the continuous medium along the first transport path or the second transport path; and a print media conveyor system that conveys the continuous print media between the source of the continuous print media, the first marking engine and the second marking engine, and between the first marking engine, the second marking engine and the output destination, the conveyor system comprising the bidirectional guide;

wherein the first marking engine and the second marking engine operate in a simplex mode where an image is formed on a front surface of the continuous print media and in a duplex mode where an image is also formed on a rear surface on the continuous print media.

14. The printing system according to claim 13, wherein:

in the simplex mode, the continuous print media is fed from the source of the continuous print media and transported to the output destination via the first marking engine and the second transport path, and in the duplex mode, the continuous print media is transported to the output destination via the first marking engine, the first transport path, and the second marking engine.

15. The printing system according to claim 14, wherein the second marking engine is a monochrome printing module and the first marking engine is a color printing module.

16. The printing system according to claim 15, wherein the front surface and the rear surface of the continuous print media are reversed by passage of the continuous print media around a turn bar disposed between the first marking engine and the second marking engine.

17. The printing system according to claim 16, wherein the bidirectional guide is disposed downstream of the turn bar and the first marking engine in the direction of the first transport path.

* * * * *